US012601495B2

(12) United States Patent
Chen

(10) Patent No.: US 12,601,495 B2
(45) Date of Patent: Apr. 14, 2026

(54) FIREPLACE SCREEN

(71) Applicant: Foshan Lizhao Metal Products Co., Ltd., Foshan (CN)

(72) Inventor: Zhengliang Chen, Yulin (CN)

(73) Assignee: Foshan Lizhao Metal Products Co., Ltd., Foshan (CN)

( * ) Notice: Subject to any disclaimer, the term of this patent is extended or adjusted under 35 U.S.C. 154(b) by 388 days.

(21) Appl. No.: 18/346,286

(22) Filed: Jul. 3, 2023

(65) Prior Publication Data

US 2025/0012447 A1 Jan. 9, 2025

(51) Int. Cl.
*F24B 1/192* (2006.01)

(52) U.S. Cl.
CPC ..... *F24B 1/192* (2013.01)

(58) Field of Classification Search
CPC ..... F24B 1/192
See application file for complete search history.

(56) References Cited

U.S. PATENT DOCUMENTS 2,776,707 A * 1/1957 Helwig ..... F24B 1/192 160/118
3,870,032 A * 3/1975 Lydle ..... F24B 1/192 126/549
4,059,091 A * 11/1977 Cobb ..... F24B 1/192 126/545
4,102,321 A * 7/1978 Githens ..... F24B 1/192 126/545
4,183,348 A * 1/1980 Smith ..... F24B 1/192 126/545
4,245,614 A * 1/1981 Hurwitz ..... F24B 1/192 126/502
4,572,156 A * 2/1986 Lentz ..... F24B 1/192 16/DIG. 11

FOREIGN PATENT DOCUMENTS

CN 204580683 U 8/2015
CN 208447102 U 2/2019
CN 218151831 U 12/2022

* cited by examiner

*Primary Examiner* — Alfred Basichas
(74) *Attorney, Agent, or Firm* — Nitin Kaushik

(57) ABSTRACT

The invention relates to the technical field of fireplace screen structures, and discloses a fireplace screen with a practical structure and safe use, which comprises support assemblies (610, 620, 710, 720); The frame assembly (100) has a bottom side detachably arranged with the support assembly, and the upper and lower ends of the screen assembly (400, 500) are respectively received in the lower groove (130) and the upper groove (140); Movable assemblies (430, 530) arranged on the lower end face of the screen assembly and received in the lower groove, and the screen assembly is laterally slidable in the lower groove and the upper groove through the movable assemblies.

11 Claims, 16 Drawing Sheets

FIREPLACE SCREEN

TECHNICAL FIELD

The invention relates to the technical field of fireplace screen structures, in particular to a fireplace screen.

BACKGROUND

The traditional fireplace door-opening screen is usually fixed by hinges or hinges. When it is opened, it is necessary to turn the door to the outside of the fireplace. However, such a setting has always had the following problems:

On the one hand, objects cannot be placed in front of the door, which makes the space in front of the fireplace screen unusable;

On the other hand, when the door is opened, because the center of gravity of the door deviates, it is easy to cause the center of gravity to be unstable and turn over, which is easy to cause safety problems.

Therefore, how to improve the use space and safety in front of the fireplace screen door has become an urgent technical problem for technicians in this field.

SUMMARY

The technical problem to be solved by the invention is that other things cannot be stacked in front of the door in the prior art, so that the space in front of the fireplace screen door cannot be utilized; And when the door is opened, because the center of gravity of the door deviates, it is easy to cause the center of gravity to be unstable and turn over, which is easy to cause safety problems.

The technical scheme adopted by the invention to solve the technical problems is as follows: a fireplace screen is constructed, which comprises:

A support assembly, the support assembly at least comprises a first support and a second support, the first support is arranged at one end of the bottom side of the frame assembly and is detachably arranged with the frame assembly, the second support is arranged at the other end of the bottom side of the frame assembly and is detachably arranged with the frame assembly;

A frame assembly, the bottom side of which is detachably coupled to the support assembly, and the support assembly fixes the frame assembly, wherein the frame assembly is supported solely by the support assembly without attachment to a fireplace structure or wall, the inner side of the frame assembly is provided with a lower groove and an upper groove, the first support is positioned at one end of the bottom side of the frame assembly and is detachably coupled to the frame assembly, the second support is positioned at the other end of the bottom side of the frame assembly and is detachably coupled to the frame assembly;

A screen assembly, the upper and lower ends of the screen assembly are respectively received within the lower groove and the upper groove;

A movable assembly, the movable assembly including a first movable assembly and a second movable assembly, the movable assembly is mounted on the lower end face of the screen assembly and configured to be received within the lower groove, and the screen assembly is laterally slidable in the lower groove and the upper groove through the movable assembly.

In some embodiments, the screen assembly includes a first movable screen assembly and a second movable screen assembly.

The movable assembly comprises a first movable assembly and a second movable assembly.

The first movable assembly is fixed to the lower end face of the first movable screen assembly and correspondingly received in the lower groove;

The second movable assembly is fixed to the lower end face of the second movable screen assembly and correspondingly received in the lower groove;

The first movable screen assembly and the second movable screen assemblies are laterally slidable in the lower groove and the upper groove through the first movable assembly and the second movable assembly.

In some embodiments, the first movable screen assembly can move relatively along one side or the opposite side of the second movable screen assembly through the first movable assembly;

The second movable screen assembly can move relatively along one side of the first movable screen assembly or the opposite side of the first movable screen assembly through the second movable assembly.

In some embodiments, the first movable assembly including at least a first support frame and a first pulley;

The first pulley is arranged in the first support frame;

The first support frame is fixed to two ends of the bottom side of the first movable screen assembly.

In some embodiments, the second movable assembly at least comprises a second support frame and a second pulley;

The second pulley is arranged in the second support frame;

The second support frame is fixed at two ends of the bottom side of the second movable screen assembly.

In some embodiments, a positioning assembly is arranged in the middle section of the lower groove of the frame assembly;

The positioning assembly limits the first movable screen assembly or the second movable screen assembly when moving laterally.

In some embodiments, it also includes a lower steel plate assembly and an upper steel plate assembly.

The lower steel plate assembly is arranged at the lower end of the frame assembly to form the lower groove with the frame assembly;

The upper steel plate assembly is arranged at the upper end of the frame assembly and forms the upper groove with the frame assembly.

In some embodiments, the support assembly includes at least a first support and a second support;

The first support is arranged at one end of the bottom side of the frame assembly and is detachably arranged with the frame assembly;

The second support is arranged at the other end of the bottom side of the frame assembly and is detachably arranged with the frame assembly.

In some embodiments, a first handle is arranged at the front end of the first movable screen assembly, and the first handle is detachably arranged with the first movable screen assembly;

A second handle is arranged at the front end of the second movable screen assembly, and the second handle and the second movable screen assembly are detachably arranged.

In some embodiments, magnet mechanisms are respectively arranged inside the first handle and the second handle.

In some embodiments, the screen assembly includes a first fixed screen assembly and a second fixed screen assembly;

The first fixed screen assembly and the second fixed screen assembly are respectively mounted on the left and right sides of the frame assembly.

In some embodiments, the inner frame of the screen assembly is provided with a rigid screen.

The fireplace screen of the invention comprises a supporting assembly, a frame assembly, a screen assembly and a movable assembly, wherein the supporting assembly is used for fixing the frame assembly, and the upper and lower ends of the screen assembly are respectively received in a lower groove and an upper groove; The movable assembly is mounted on the lower end face of the screen assembly and received in the lower groove, and the screen assembly is laterally slidable in the lower groove and the upper groove through the movable assembly. Compared with the prior art, the movable assembly is arranged at the lower end face of the screen assembly, so that the screen assembly can move transversely along the groove of the frame assembly through the movable assembly, so that the fireplace screen can be opened transversely, and the space in front of the screen door can be released, so that some decorative ornaments can be stacked by fully utilizing the space in front of the screen door without affecting the use of the screen;

On the other hand, the structure of the left and right horizontal door opening can prevent the center of gravity from shifting when the screen door is opened or closed, which solves the problem that the traditional door opening screen is easy to overturn, and the ingenious guide rail design greatly reduces the process difficulty, improves the production efficiency and durability, and reduces the product manufacturing cost.

BRIEF DESCRIPTION OF DRAWINGS

The invention will be further described with reference to the attached drawings and examples, in which.

DETAILED DESCRIPTION OF THE EMBODIMENTS

Figure 1:
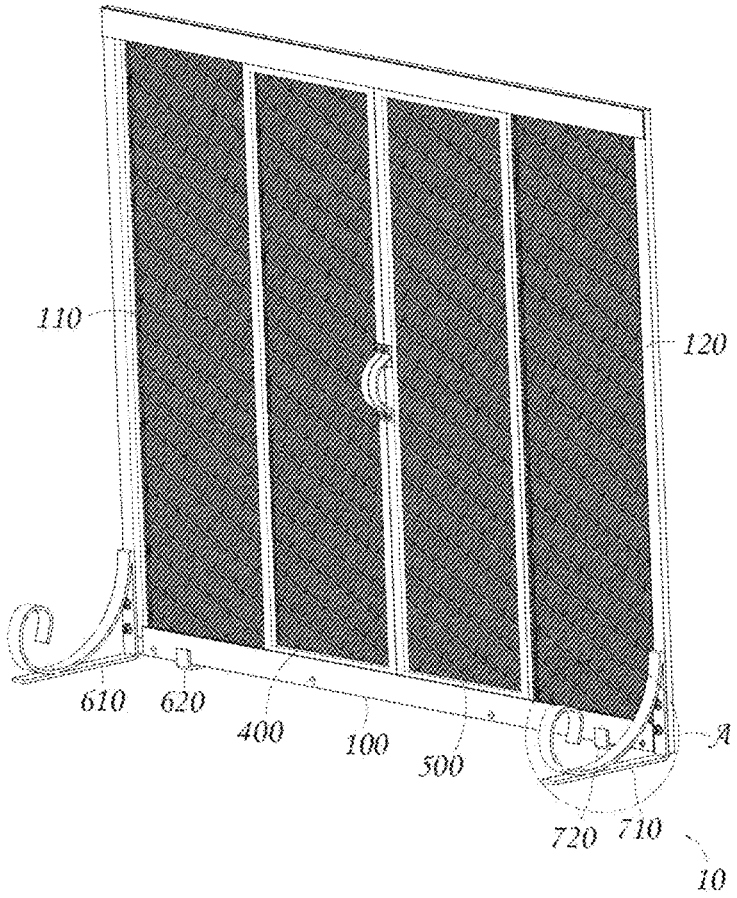
FIG. 1 is a perspective view of an embodiment of a fireplace screen provided by the present invention.

In order to have a clearer understanding of the technical features, purposes and effects of the present invention, specific embodiments of the present invention will now be described in detail with reference to the attached drawings.

As shown in FIGS. 1, 2, 3, 5, 6 and 15, in the first embodiment of the fireplace screen of the present invention, the fireplace screen 10 includes a frame assembly 100, screen assemblies (corresponding to 400 and 500), movable assemblies (corresponding to 430 and 530) and support assemblies (corresponding to 610, 620, 710 and 720).

The frame assembly 100 has a square structure, which forms a hollow inner frame, and the inner frame is provided with a middle inner frame 100*a*, a left inner frame 100*b* and a right inner frame 100*c*.

The frame assembly 100 supports the screen assemblies (corresponding to 110, 120, 400 and 500), and Grooves (corresponding to 130 and 140) are formed at the inner sides of its upper and lower ends for the screen assembly (corresponding to 400 and 500) to move laterally;

Screen assemblies (corresponding to 110, 120, 400, 500) at least include fixed screen assemblies (corresponding to 110, 120) and movable screen assemblies (corresponding to 400, 500), which are used to isolate children and pets from fire sources and protect the safety of children and pets and carpets and floors around the fireplace;

Among them, one group of screen assemblies (corresponding to 110, 120) are respectively arranged in the left inner frame 100*b* and the right inner frame 100*c*, and the other group of screen assemblies (corresponding to 400, 500) are respectively arranged in the middle inner frame 100*a* to fix the screen assemblies (corresponding to 110, 120, 400, 500);

The movable assemblies (corresponding to 430, 530) are used to facilitate movement for the movable screen assemblies (corresponding to 400, 500) when the grooves (corresponding to 130 and 140) move laterally;

The supporting assemblies (corresponding to 610, 620, 710, 720) are used to provide supporting moment for the frame assembly 100 when it stands, so as to ensure its stability and reliability during use.

Specifically, the supporting assemblies (corresponding to 610, 620, 710 and 720) are detachably arranged at the front and rear ends of the bottom side of the frame assembly 100, and form an included angle of about 90 degrees with the front end surface of the frame assembly 100, thereby fixing the frame assembly 100.

Among them, the supporting assemblies (corresponding to 610, 620, 710 and 720) are riveted or clamped at the front and rear ends of the bottom side of the frame assembly 100 by screws.

Further, the front end and the rear end of the bottom side of the frame assembly 100 are respectively detachably arranged with the support assembly (corresponding to 610, 620, 710, 720) and form an included angle of 90 degrees with the support assembly (corresponding to 610, 620, 710, 720) to fix the frame assembly 100, so that the frame assembly 100 can pass through the support assembly (corresponding to 610).

Among them, a lower groove 130 (or a lower guide rail) and an upper groove 140 (or an upper guide rail) which are transversely arranged are respectively arranged at the inner side of the lower end and the upper end of the frame assembly 100.

Further, the upper and lower ends of the screen assemblies (corresponding to 400, 500) are respectively received in the lower groove 130 (or the lower guide rail) and the upper groove 140 (or the upper guide rail), so that the screen assemblies (corresponding to 400, 500) are movably arranged in the middle inner frame 100*a* of the frame assembly 100.

Further, the movable assembly (corresponding to 430, 530) is fixedly or detachably mounted on the lower end face of the screen assembly (corresponding to 400, 500), and when the screen assembly (corresponding to 400, 500) is received in the lower groove 130 (or the lower guide rail) and exerts a pulling force to the screen assembly (corresponding to 400, 500) to the left or right, the screen assembly (corresponding to 400, 500)

By using the technical scheme, the movable assemblies (corresponding to 430, 530) are mounted on the lower end faces of a group of screen assemblies (corresponding to 400, 500), so that the screen assemblies (corresponding to 400, 500) is laterally slidable along the grooves (corresponding to 130 and 140) of the frame assembly 100 through the movable assemblies (corresponding to 430, 530), so that the fireplace screen can be opened laterally.

On the other hand, the structure of the left and right horizontal door opening can prevent the center of gravity from shifting when the screen door is opened or closed, which solves the problem that the traditional door opening screen is easy to overturn, and the ingenious guide rail design greatly reduces the process difficulty, improves the production efficiency and durability, and reduces the product manufacturing cost.

Figure 2:
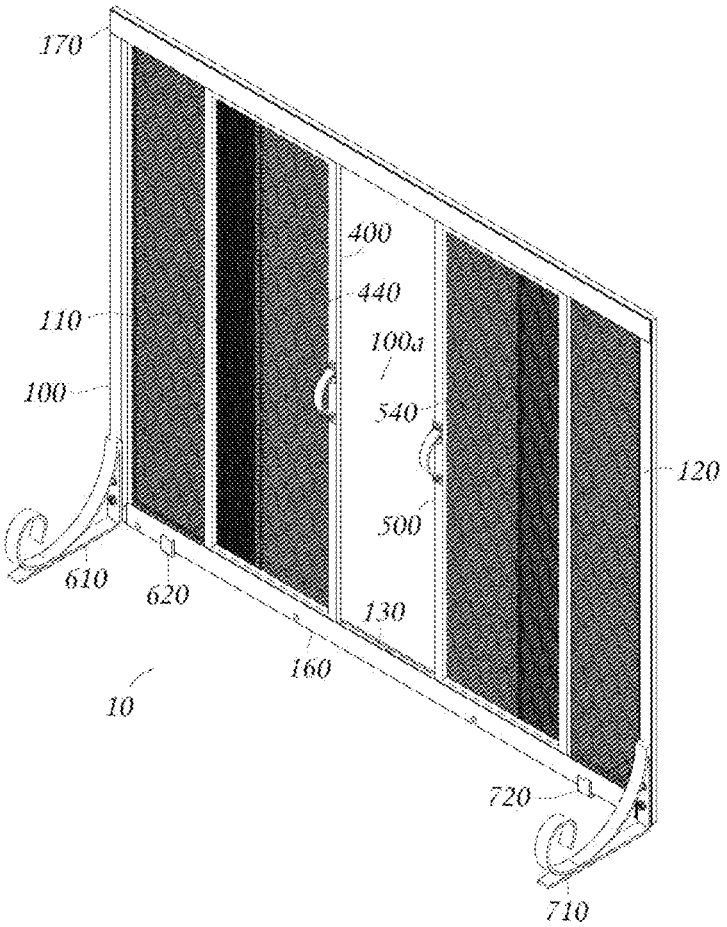
FIG. 2 is a perspective view of another embodiment of the fireplace screen provided by the present invention.
Figure 3:
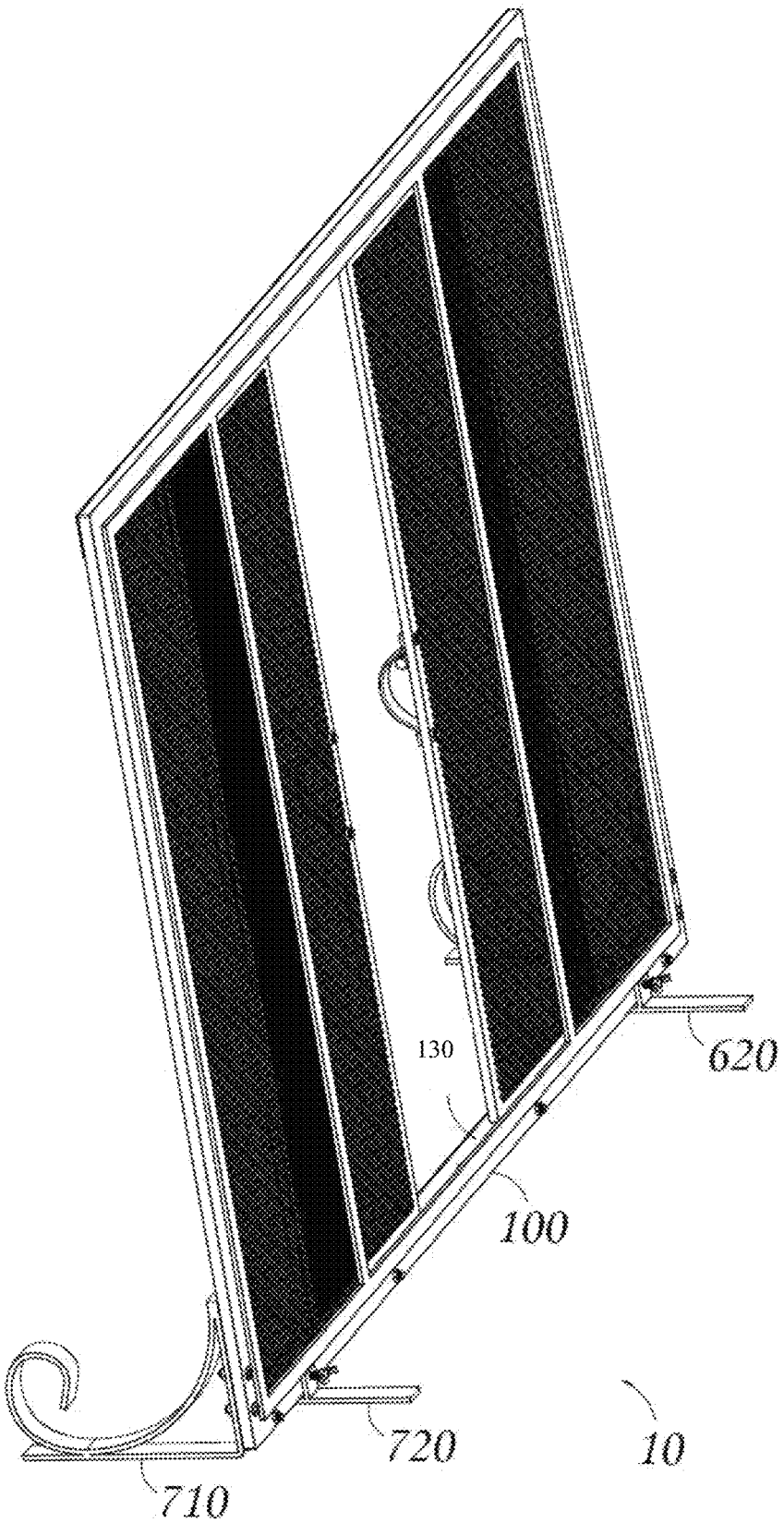
FIG. 3 is a perspective view of another embodiment of the fireplace screen provided by the present invention.

In some embodiments, in order to improve the convenience of using fireplace screens, as shown in FIGS. 2 and 3, a first movable screen assembly (corresponding to 400) and a second movable screen assembly (corresponding to 500) are provided in screen assemblies (corresponding to 400), and the first movable screen assembly (corresponding to 400) and the second movable screen assembly (corresponding to 500) have a square structure; and A first movable assembly (corresponding to 430) and a second movable assembly (corresponding to 530) are provided in the movable assemblies (corresponding to 430, 530), which are used for providing transmission assistance for lateral movement of the first movable screen assembly (corresponding to 400) and the second movable screen assembly (corresponding to 500);

Specifically, the first movable assembly (corresponding to 430) is fixedly or detachably mounted on the lower end face of the first movable screen assembly (corresponding to 400), and it is correspondingly received into the lower groove 130 (or the lower guide rail) along with the first movable assembly (corresponding to 430) to support the first movable assembly (corresponding to 430) and provide transmission assistance for lateral movement;

The second movable assembly (corresponding to 530) is fixedly or detachably mounted on the lower end face of the second movable screen assembly (corresponding to 500), and it is correspondingly received into the lower groove 130 (or the lower guide rail) to support the second movable assembly (corresponding to 530) and provide transmission assistance for lateral movement.

The first movable screen assembly (corresponding to 400) is laterally slidable in the lower groove 130 (or the lower guide rail) and the upper groove 140 (or the upper guide rail) through the first movable assembly (corresponding to 430); and The second movable screen assembly (corresponding to 500) is laterally slidable in the lower groove 130 and the upper groove 140 through the second movable assembly (corresponding to 530).

That is, when the first movable screen assembly (corresponding to 400) and the second movable screen assembly (corresponding to 500) exert lateral tension, the first movable screen assembly (corresponding to 400) moves laterally in the lower groove 130 (or the lower guide rail) and the upper groove 140 (or the upper guide rail) through the transmission assistance provided by the first movable assembly (corresponding to 430); and The second movable screen assembly (corresponding to 500) moves laterally in the lower groove 130 and the upper groove 140 through the transmission assistance provided by the second movable assembly (corresponding to 530).

Further, as shown in FIGS. 2 and 3, the first movable screen assembly (corresponding to 400) can move relatively along one side or the opposite side of the second movable screen assembly (corresponding to 500) through the first movable assembly (corresponding to 430);

The second movable screen assembly (corresponding to 500) can move relatively along one side or the opposite side of the first movable screen assembly (corresponding to 400) through the second movable assembly (corresponding to 530).

In some embodiments, in order to ensure the reliability of the lateral movement of the first movable screen assembly (corresponding to 400), as shown in FIG. 7, FIG. 13, FIG. 15 and FIG. 16, at least a first support frame 401 and a first pulley 430 are provided in the first movable assembly (corresponding to 430).

Figure 16:
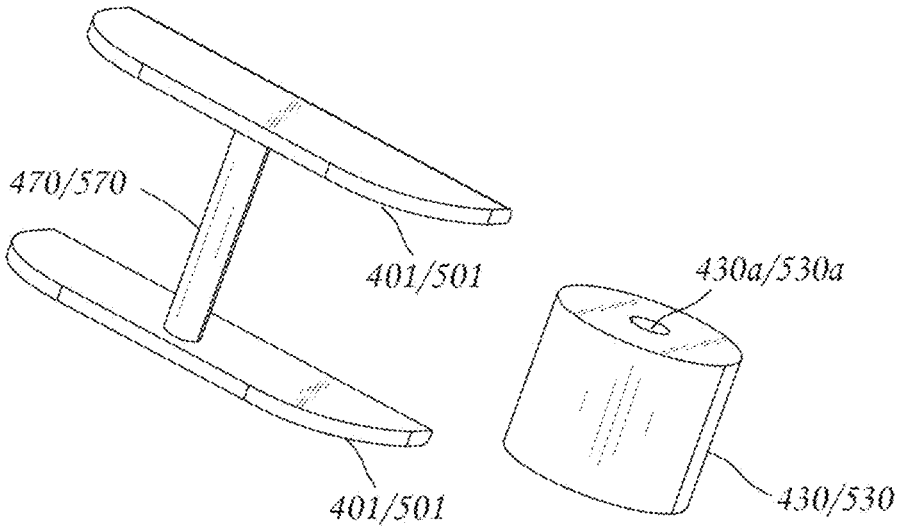
FIG. 16 is an exploded view of an embodiment of the movable assembly provided by the present invention.

As shown in FIG. 16, an axial connecting rod 470 is arranged in the first support frame 401.

The first pulley 430 (or a bearing or a copper sleeve) is arranged in a center structure, and a through hole 430*a*; is formed at the center position;

In configuration, the first pulley 430 is sleeved in the connecting rod 470 of the first support frame 401, so that the first pulley 430 can rotate through the connecting rod 470.

Specifically, the first pulley 430 is arranged in the first support frame 401, and a gap is formed between both ends of the first pulley 430 and the inside of the first support frame 401;

The first support frames 401 are fixedly arranged at both ends of the bottom side of the first movable screen assembly (corresponding to 400).

Specifically, two groups of first movable screen assemblies (corresponding to 400) are installed at the lower part of the first movable screen assembly (corresponding to 400), so that the first movable screen assembly (corresponding to 400) is driven by the first pulley 430 (or bearing or copper sleeve), so that the friction coefficient of mechanical load of the first movable screen assembly (corresponding to 400) in the transmission process can be reduced, and the door can be opened more smoothly and smoothly by moving horizontally.

In some embodiments, in order to ensure the reliability of the lateral movement of the second movable screen assembly (corresponding to 500), as shown in FIGS. 8, 14, 15 and 16, at least a second support frame 501 and a second pulley 530 is provided in the second movable assembly (corresponding to 530).

As shown in FIG. 16, an axial connecting rod 570 is arranged in the second support frame 501:

The second pulley 530 (or a bearing or a copper sleeve) is arranged in a center structure, and a through hole 530*a*; is formed at the center position;

In configuration, the second pulley 530 is sleeved in the connecting rod 570 of the second support frame 501, so that the second pulley 530 can rotate through the connecting rod 570.

Specifically, the second pulley 530 is arranged in the second support frame 501, and a gap is formed between both ends of the second pulley 530 and the inside of the second support frame 501;

The second support frame 501 is fixed at both ends of the bottom side of the second movable screen assembly (corresponding to 500).

Specifically, by installing two groups of second movable screen assemblies (corresponding to 500) at the lower part of the second movable screen assembly (corresponding to 500), the second movable screen assembly (corresponding to 500) is driven by the second pulley 530 (or bearing or copper sleeve), so that the mechanical load friction coefficient of the second movable screen assembly (corresponding to 500) in the transmission process can be reduced, and the door can be opened more smoothly and smoothly by moving horizontally.

Figure 5:
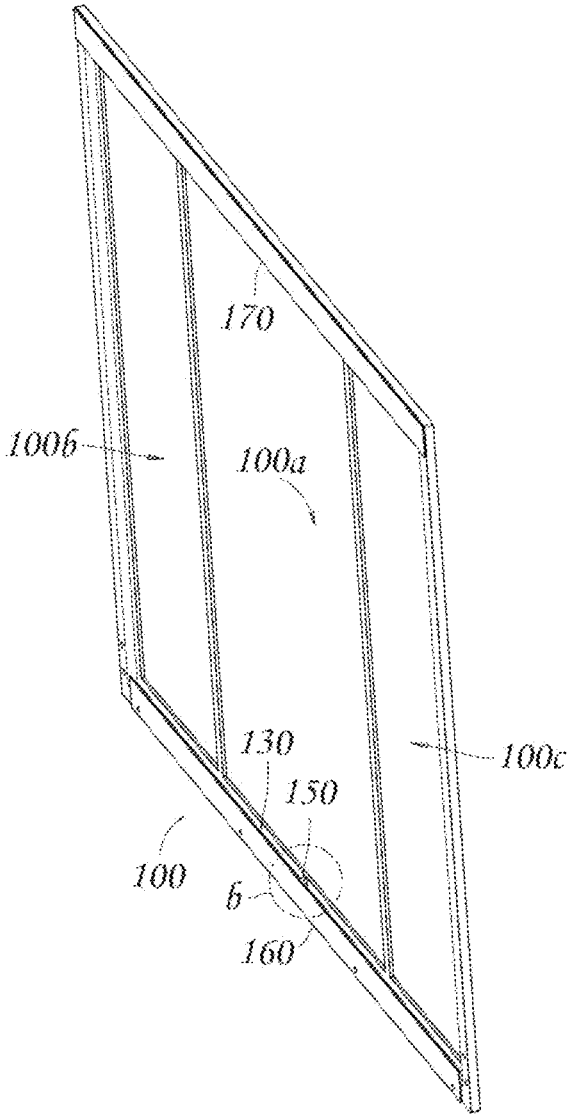
FIG. 5 is a perspective view of another embodiment of the frame assembly provided by the present invention.
Figure 6:
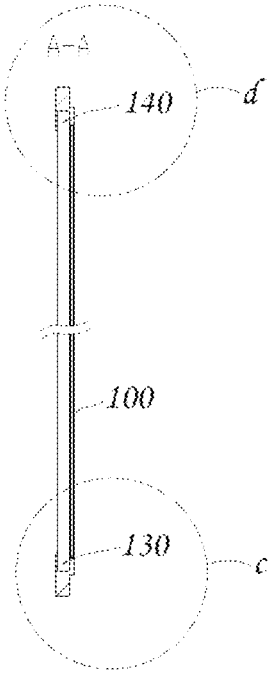
FIG. 6 is a sectional view of an embodiment of a frame assembly provided by the present invention.
Figure 10:
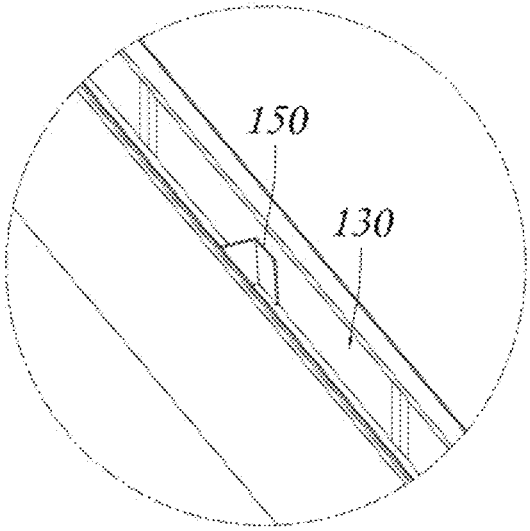
FIG. 10 is a partial enlarged view of b in FIG. 5 provided by the present invention.
Figure 11:
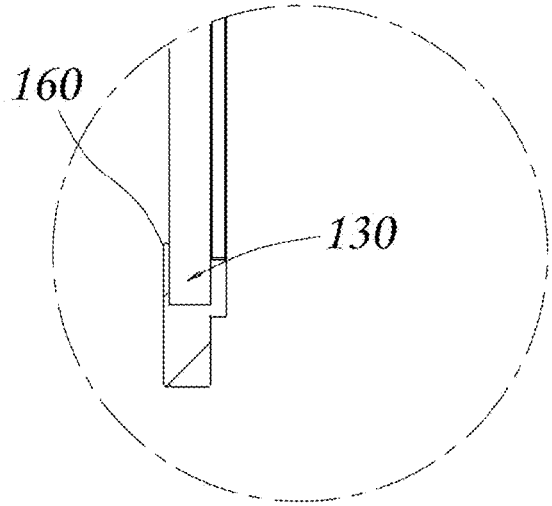
FIG. 11 is a partial enlarged view of c in FIG. 6 provided by the present invention.
Figure 12:
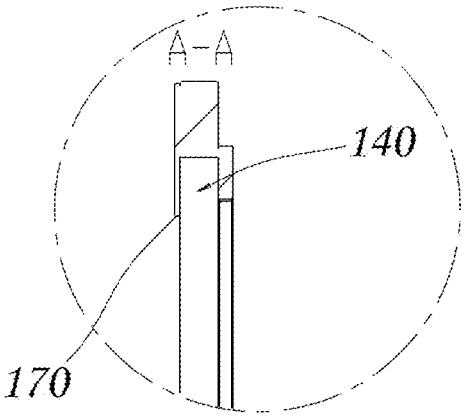
FIG. 12 is a partial enlarged view of d in FIG. 6 provided by the present invention.
Figure 13:
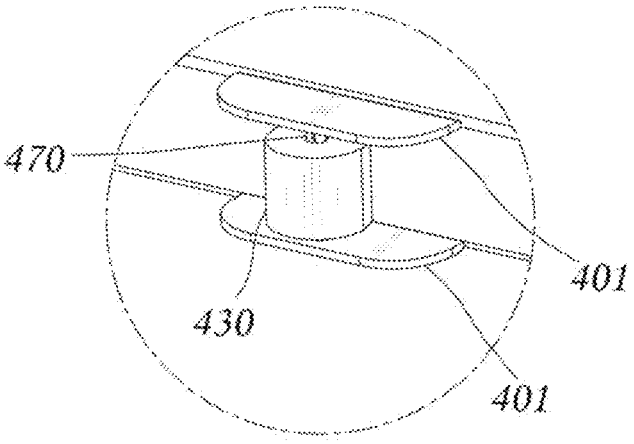
FIG. 13 is a partial enlarged view of e in FIG. 7 provided by the present invention.
Figure 14:
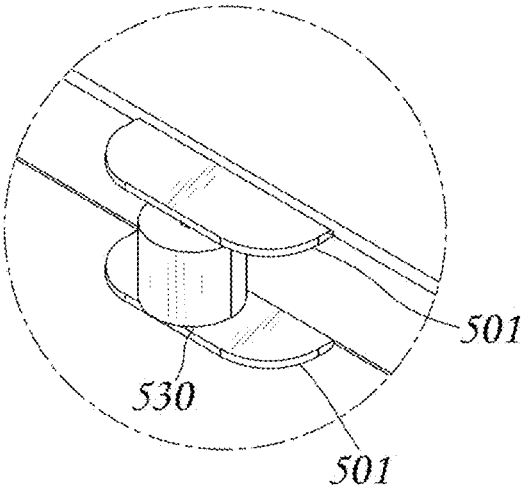
FIG. 14 is a partial enlarged view of F in FIG. 8 provided by the present invention.
Figure 15:
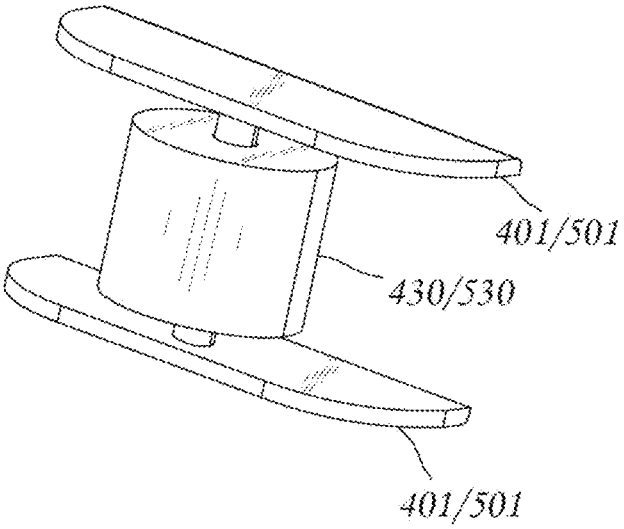
FIG. 15 is a perspective view of an embodiment of the movable assembly provided by the present invention.

In some embodiments, in order to ensure the certainty that the first movable screen assembly (corresponding to 400) and the second movable screen assembly (corresponding to 500) move to relative positions in the lateral direction, as shown in FIGS. 5 and 10, a positioning assembly 150 is provided in the middle of the lower groove 130 (or the lower guide rail) of the frame assembly 100, which is arranged as a flat rigid block to evenly divide the lower groove 130 (or the lower guide rail).

Specifically, the positioning assembly 150 is used to limit the lateral movement of the first movable screen assembly (corresponding to 400) or the second movable screen assembly (corresponding to 500) to the relative position, so as to prevent the user from dislocating the first movable screen assembly (corresponding to 400) or the second movable screen assembly (corresponding to 500) due to excessive force.

Specifically, the positioning assembly 150 is arranged at the middle section of the lower groove 130 (or the lower guide rail), which can prevent the movable screen from being dislocated due to excessive force when the user uses it. Even if the user closes the door with greater force than usual, the movable screen will not be dislocated; At the same time, when the baby and the pet are prevented from colliding with this product, the whole movable screen will not be moved.

In some embodiments, as shown in FIGS. 2, 4, 5 and 6, a lower steel plate assembly 160 and an upper steel plate assembly 170 may be arranged on the front end face of the frame assembly 100, wherein the lower steel plate assembly 160 and the upper steel plate assembly 170 are transversely mounted on the front end face of the frame assembly 100.

Specifically, the lower steel plate assembly 160 is detachably arranged at the lower end of the frame assembly 100, which forms a lower groove 130 (or a lower guide rail) with the frame assembly 100;

The upper steel plate assembly 170 is detachably arranged at the upper end of the frame assembly 100, and forms an upper groove 140 (or a lower guide rail) with the frame assembly 100.

Specifically, the lower steel plate assembly 160 and the upper steel plate assembly 170 are assembled with the main frame of the frame assembly 100 by screws. On the one hand, they form upper inverted U-shaped grooves and lower U-shaped grooves with the main frame and the fixed mesh frame, so that the guide rail structure can be created without complicated structures and profile materials, which greatly reduces the process difficulty, improves the production efficiency and reduces the product cost.

On the other hand, it solves the surface treatment quality of the whole set of products and guide rails, and improves the rust resistance and durability of product surface treatment.

In some embodiments, as shown in FIGS. 1-3, a first support (corresponding to 610 and 620) and a second support (corresponding to 710 and 720) are provided in a support assembly (corresponding to 610, 620, 710 and 720), wherein the first support (corresponding to 610) is detachably mounted on the front end surface of the bottom side of the frame assembly 100.

Figure 9:
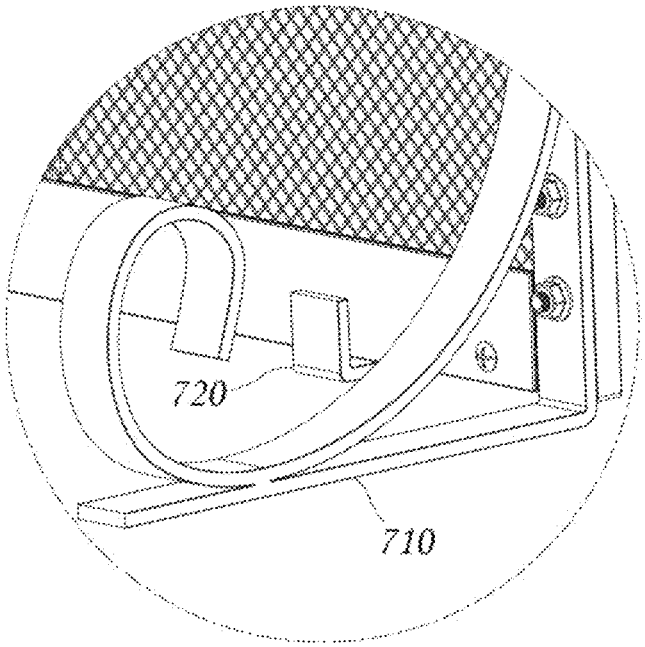
FIG. 9 is a partial enlarged view of a in FIG. 1 provided by the present invention.

The first support (corresponding to 620) is detachably mounted on the rear end face of the bottom side of the frame assembly 100, and forms an included angle of about 90 degrees with the rear end face of the frame assembly 100;

Further, as shown in FIG. 9, the second support (corresponding to 710) is detachably mounted on the front end surface of the bottom side of the frame assembly 100, which forms an included angle of about 90 degrees with the front end surface of the frame assembly 100;

The second support (corresponding to 720) is detachably mounted on the rear end face of the bottom side of the frame assembly 100, and forms an included angle of about 90 degrees with the rear end face of the frame assembly 100.

Specifically, the first support (corresponding to 610 and 620) is detachably arranged at one end of the bottom side of the frame assembly 100, which is detachably arranged with the frame assembly 100;

The second support (corresponding to 710 and 720) is arranged at the other end of the bottom side of the frame assembly 100 (opposite to the first support (corresponding to 610 and 620)), which is detachably arranged with the frame assembly 100. By arranging the first support (corresponding to 610 and 620) and the second support (corresponding to 710 and 720) on the bottom side of the frame assembly 100, the frame assembly 100

Figure 7:
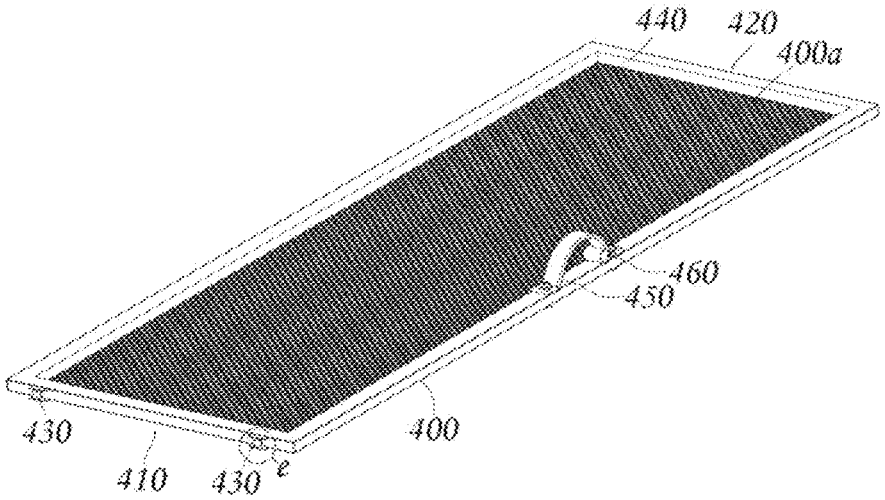
FIG. 7 is a perspective view of an embodiment of the first movable screen assembly provided by the present invention.
Figure 8:
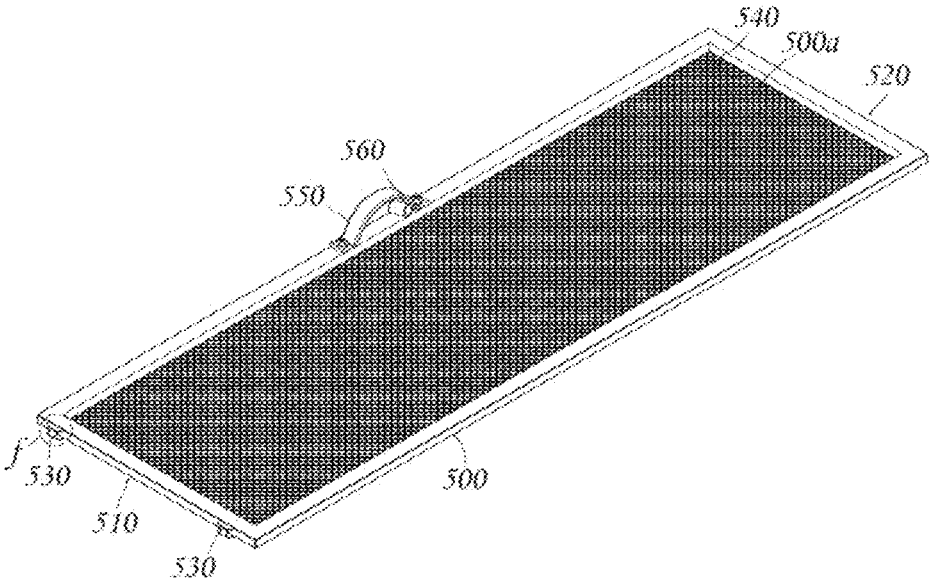
FIG. 8 is a perspective view of an embodiment of the second movable screen assembly provided by the present invention.

In some embodiments, for the convenience of screen use, as shown in FIGS. 2, 7 and 8, a first handle 450 is provided at the front end of the first movable screen assembly (corresponding to 400), wherein the first handle 450 and the first movable screen assembly (corresponding to 400) can be detachably arranged; and A second handle 550 is provided at the front end of the second movable screen assembly (corresponding to 500), wherein the second handle 550 and the second movable screen assembly (corresponding to 500) can be detachably arranged.

In some embodiments, as shown in FIG. 7 and FIG. 8, magnet mechanisms (corresponding to 460 and 560) can be respectively arranged inside the first handle 450 and the second handle 550 in order to improve the tightness of the lateral movement of the movable screen.

Specifically, the first handle 450 and the second handle 550 are internally provided with magnet mechanisms (corresponding to 460 and 560), which automatically attract and close the movable screen in the lateral direction when it is close, so as to realize the automatic lateral suction function;

On that other hand, when the door is open left and right, a damper effect can be generate, so that a user can have a good hand feeling; even if a baby collides with a pet, the movable screen is not easy to push open, and the use is safer.

Figure 4:
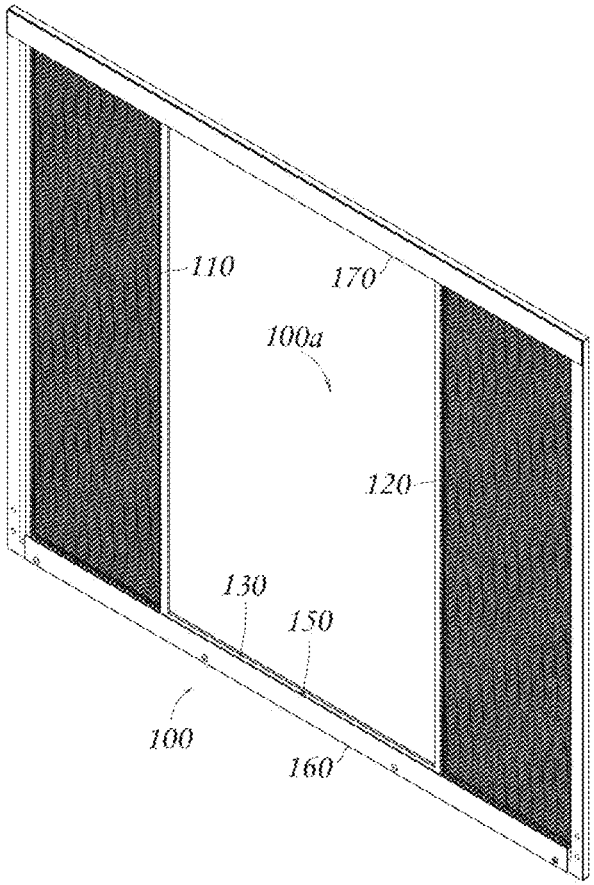
FIG. 4 is a perspective view of an embodiment of a frame assembly provided by the present invention.

In some embodiments, as shown in FIGS. 1, 4 and 5, the fixed screen assembly is arranged as a first fixed screen assembly 110 and a second fixed screen assembly 120, wherein the first fixed screen assembly 110 is fixed in the left inner frame 100*b* of the frame assembly 100, The second fixed screen assembly 120 is fixed at the right inner frame 100*c* of the frame assembly 100.

In some embodiments, as shown in FIGS. 7 and 8, rigid screens (corresponding to 440 and 540) are provided in the inner frames (corresponding to 400*a* and 500*a*) of the screen assembly.

The embodiments of the present invention have been described above with reference to the attached drawings, but the present invention is not limited to the above specific embodiments, which are only schematic, not restrictive. Under the inspiration of the present invention, ordinary technicians in the field can make many forms without departing from the purpose of the present invention and the scope protected by the claims, which are all within the protection of the present invention.

What is claimed is:

1. A fireplace screen, comprising:

a support assembly, the support assembly including at least a first support and a second support;

a frame assembly, the bottom side of which is detachably coupled to the support assembly, and the support assembly fixes the frame assembly, wherein the frame assembly is supported solely by the support assembly without attachment to a fireplace structure or wall, the inner side of the frame assembly is provided with a lower groove and an upper groove, the first support and the second support being respectively positioned at opposite ends of a bottom side of the frame assembly and detachably coupled thereto;

a screen assembly, the upper and lower ends of the screen assembly are respectively received within the lower groove and the upper groove;

a movable assembly, the movable assembly including a first movable assembly and a second movable assembly, the movable assembly is mounted on the lower end face of the screen assembly and configured to be received within the lower groove, and the screen assembly is laterally slidable in the lower groove and the upper groove through the movable assembly, the first movable assembly including at least a first support frame and a first pulley, the second movable assembly including at least a second support frame and a second pulley.

2. The fireplace screen according to claim 1, wherein, also comprises a lower steel plate assembly and an upper steel plate assembly, the lower steel plate assembly is arranged at the lower end of the frame assembly to form the lower groove with the frame assembly, the upper steel plate assembly is arranged at the upper end of the frame assembly and forms the upper groove with the frame assembly.

3. The fireplace screen according to claim 1, wherein, the screen assembly comprises a first movable screen assembly and a second movable screen assembly, the movable assembly comprises a first movable assembly and a second movable assembly, the first movable assembly is fixed on the lower end face of the first movable screen assembly and correspondingly received in the lower groove;

the second movable assembly is fixed on the lower end face of the second movable screen assembly and correspondingly embedded in the lower groove;

the first movable screen assembly and the second movable screen are laterally slidable in the lower groove and the upper groove through the first movable assembly and the second movable assembly.

4. The fireplace screen according to claim 2, wherein, a positioning assembly is arranged in the middle section of the lower groove of the frame assembly, the positioning assembly the first movable screen assembly or the second movable screen assembly when moving laterally.

5. The fireplace screen according to claim 2, wherein, the first movable screen assembly can move relatively along one side of the second movable screen assembly or the opposite side of the second movable screen assembly through the first movable assembly;

the second movable screen assembly can move relatively along one side of the first movable screen assembly or the opposite side of the first movable screen assembly through the second movable assembly.

6. The fireplace screen according to claim 5, wherein, the first pulley is arranged in the first support frame, the first support frame at two ends of the bottom side of the first movable screen assembly.

7. The fireplace screen according to claim 5, wherein, the second pulley is arranged in the second support frame, the second support frame is fixed at two ends of the bottom side of the second movable screen assembly.

8. The fireplace screen according to claim 5, wherein, the screen assembly comprises a first fixed screen assembly and a second fixed screen assembly, the first fixed screen assembly and the second fixed screen assembly are respectively mounted on the left and right sides of the frame assembly.

9. The fireplace screen according to claim 5, wherein, a first handle is arranged at the front end of the first movable screen assembly, and the first handle is detachably arranged with the first movable screen assembly;

a second handle is arranged at the front end of the second movable screen assembly, and the second handle and the second movable screen assembly are detachably arranged.

10. The fireplace screen according to claim 9, wherein,

Magnet mechanism are respectively arranged at the inner sides of the first handle and the second handle.

11. The fireplace screen according to claim 10, wherein, the inner frame of the screen assembly is provided with a rigid screen.

* * * * *